United States Patent [19]

Delport

[11] 4,224,750

[45] Sep. 30, 1980

[54] FOOT-WEAR

[76] Inventor: Marthienes J. Delport, 21 Church St., Strand, South Africa

[21] Appl. No.: 684,900

[22] Filed: May 10, 1976

[30] Foreign Application Priority Data

| | | | |
|---|---|---|---|
| May 16, 1975 | [ZA] | South Africa | 75/3187 |
| Oct. 2, 1975 | [ZA] | South Africa | 75/6254 |
| Nov. 24, 1975 | [ZA] | South Africa | 75/7336 |

[51] Int. Cl.[2] ..... A43B 7/22; A43B 5/02

[52] U.S. Cl. ..... 36/91; 36/128

[58] Field of Search ..... 36/71, 76 R, 76 HH, 36/28, 43, 128, 126, 91, 129, 134

[56] References Cited

U.S. PATENT DOCUMENTS

| | | | |
|---|---|---|---|
| 1,617,418 | 2/1927 | Richardson | 36/126 |
| 2,572,680 | 10/1951 | Treat | 36/129 |
| 2,902,780 | 9/1959 | Bellew | 36/134 |
| 3,327,411 | 6/1967 | Roberts | 36/134 |
| 3,406,469 | 10/1968 | Dani | 36/128 |
| 3,641,688 | 2/1972 | von den Benken | 36/43 |
| 3,766,669 | 10/1973 | Pearsall | 36/43 |

*Primary Examiner*—Patrick D. Lawson

*Attorney, Agent, or Firm*—Larson, Taylor and Hinds

[57] ABSTRACT

A shoe which includes a metatarsal arch support comprising a heel portion; a medial portion extending from the heel portion; and a metatarsal portion extending from the medial portion and terminating in a round metatarsal edge; which support increases in width from the medial portion to the metatarsal edge; the medial portion having a curved transverse cross-sectional shape; and the metatarsal portion having a crescent transverse cross-sectional shape which flattens by way of a wedge-shape into the round metatarsal edge; the metatarsal edge being adapted to be substantially below the joints of the five metatarsal bones to the proximal phalanges.

13 Claims, 20 Drawing Figures

FOOT-WEAR

Figure 1:
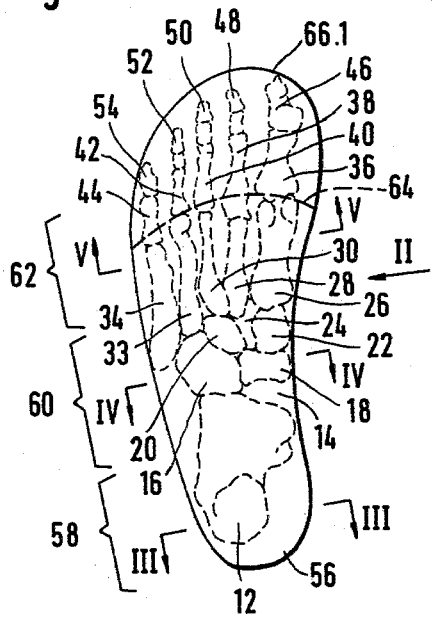

The present invention relates to foot-wear.

More particularly, the invention relates to a metatarsal arch support insert for insertion into shoes as well as to shoes provided with a metatarsal arch support.

In many shoes the internal formation does not take the natural weight-bearing parts of the foot sufficiently into consideration. This causes a strain on muscles and ligaments, in particular when heavy loads are applied to feet as happens during exercises, sporting events and even when executing heavy work or standing on hard surfaces. Consequently the muscles and ligaments supporting the arches in the foot become strained or weakened and this results in a deformation of the arches, often with painful effects for the wearer of such shoes.

A number of suggestions have been made to overcome this problem. Special shoe inserts have been developed and in the case of sport shoes, such as running or rugby or soccer boots, spikes or studs were placed in critical positions.

It is to be noted that in the specification and claims hereinafter, all references to bones of a foot are intended to refer to such bones of a proposed wearer of the shoe or the shoe including a shoe insert, such wearer having a normally shaped and dimensioned foot.

It is an object of the invention to provide a metatarsal arch support insert for shoes and a shoe including such support which will assist in counteracting over-straining of the foot so as to prevent deformation and pain or injury to the wearer.

It is an object of the invention to provide a metatarsal arch support insert for shoes and a shoe including such support which will assist in counteracting over-straining of the foot so as to prevent deformation and pain or injury to the wearer.

According to one aspect of the invention, a shoe includes a metatarsal arch support comprising a heel portion; a medial portion extending from the heel portion; and a metatarsal portion extending from the medial portion and terminating in a rounded metatarsal edge; which support increases in width from the medial portion to the metatarsal edge; the medial portion having a transverse cross-sectional shape in the form of a single wave; the metatarsal portion having a transverse cross-sectional shape in the form of a single wave, which wave is flatter than the wave of the medial portion, and the metatarsal portion flattening by way of an intermediate wedge shaped portion, as viewed in longitudinal cross-section, into the said rounded metatarsal edge; the metatarsal edge being adapted in use to be substantially below the joints of the five metatarsal bones to the proximal phalanges of the foot of a wearer; and the arch support further having a longitudinal cross-sectional shape, for the medial and the metatarsal portions taken together, in the form of a single wave, the peak of the last mentioned wave being in the metatarsal portion.

The heel portion may be spherically recessed to receive the calceneum formation.

The wave of the medial portion may have a peak which, in use, follows approximately the joint between the cuboid bone and the talus and navicular bone and being below the lateral cuneiform bone.

The metatarsal arch support may be made of resilient material.

The support may be integral with the shoe sole structure.

The shoe may be a sports shoe, eg a running shoe, a rugby or soccer shoe or a baseball shoe and it may include spikes, studs or hook supports.

In one example of a sports shoe in the form of a running shoe, the shoe is provided with spikes arranged such that, in use, two rear spikes are located respectively between the first and second metatarsal bones and between the fourth and fifth metatarsal bones, two intermediate spikes are located respectively at the end of the first proximal phalanx and the fifth proximal phalanx adjacent to the respective metatarsal bones, and two front spikes are located respectively under the first distal phalanx and the fourth distal phalanx.

In another example of a sports shoe in the form of a rugby or soccer shoe, the shoe has ten support studs, arranged such that, in use, two studs are located at the heel under the calcaneum, two studs are located below the arch formed between the various cuneiform bones and the cuboid bone on the one hand and the metatarsal bones on the other hand, two studs are respectively located between the first and second metatarsal bones and between the fourth and fifth metatarsal bones, one stud is located on the rear side of the first proximal phalanx, one stud is located in front of the joint of the fifth proximal phalanx and the fifth metatarsal bone, a front stud is located below the first distal phalanx and a stud is located below the fourth distal phalanx.

In a third example of a sports shoe, wherein the shoe is a baseball shoe, the shoe has cleats arranged such that, in use, a rear cleat is located below the calcaneum, a central cleat is located below the various cuneiform bones and the start of the various metatarsal bones, and a front cleat is located below the second proximal phalanx and the third proximal phalanx.

Also according to the invention, a metatarsal arch support insert for shoes comprises a metatarsal arch support and joined thereto an inner sole, the metatarsal arch support including a heel portion, a medial portion extending from the heel portion, and a metatarsal portion extending from the medial portion and terminating in a rounded metatarsal edge; the medial portion having a transverse cross-sectional shape in the form of a single wave; the metatarsal portion having a transverse cross-sectional shape in the form of a single wave, which wave is flatter than the wave of the medial portion, and the metatarsal portion flattening by way of a wedge-shaped portion as viewed in longitudinal cross-section, into the rounded metatarsal edge; the metatarsal edge being adapted in use to be located substantially below the joints of the five metatarsal bones to the proximal phalanges of the foot of a wearer; and the arch support further having a longitudinal cross-sectional shape, in the medial and the metatarsal portions taken together, in the form of a single wave, the peak of the last mentioned wave being in the metatarsal portion.

The wave formation of the medial portion may have a raised part adapted in use to be located under the inner arch of a foot.

The wave of the medial portion may have a peak which, in use, follows approximately the joint between the cuboid bone and the talus and navicular bone and is located below the lateral cuneiform bone.

The heel portion may be spherically recessed to receive the calcaneum formation.

The support may be made of resilient material.

The invention will now be described by way of example with reference to the accompanying schematic drawings. It must be noted that all drawings refer to a right foot or shoe for a right foot. Obviously all details will be applicable, in inverted manner, to a left foot.

Figure 3:
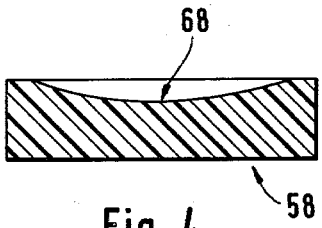
Figure 4:
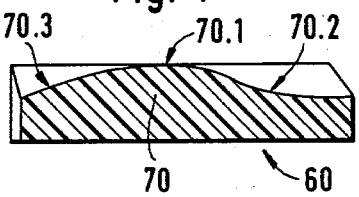
Figure 5:
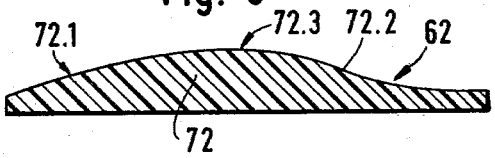
Figure 2:
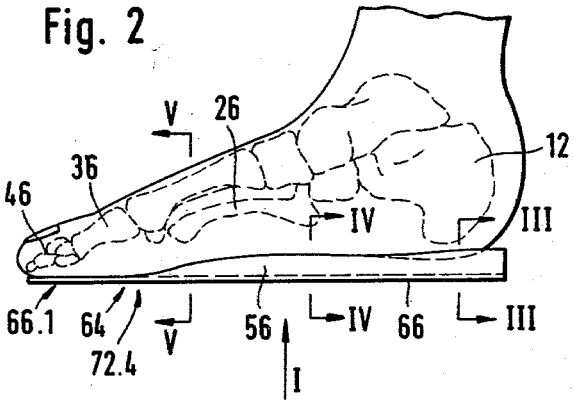
Figure 6:
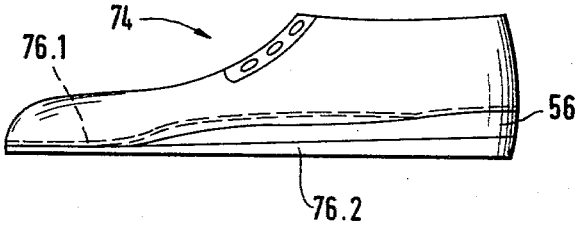
Figure 7:
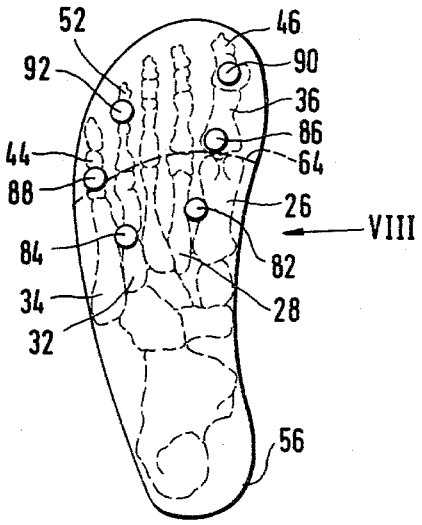
Figure 8:
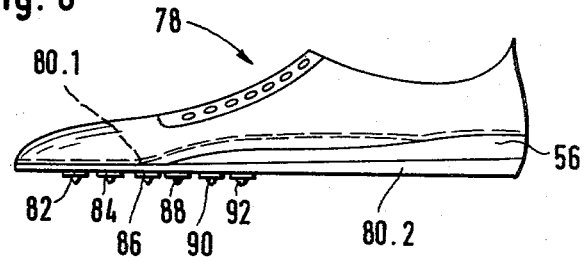
Figure 9:
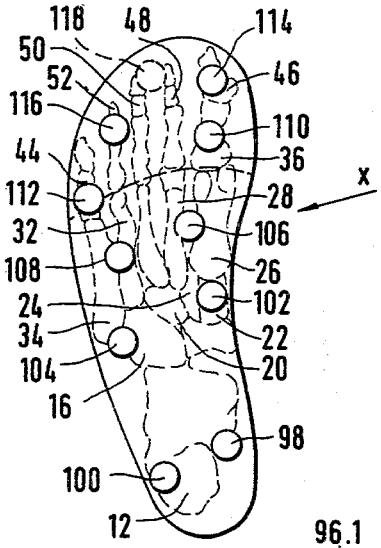
Figure 10:
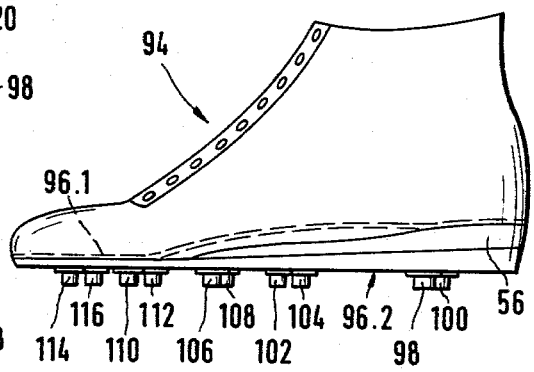
Figure 11:
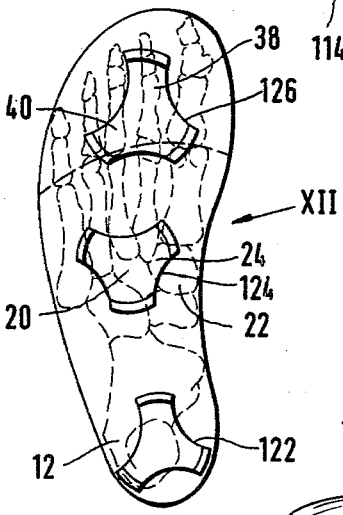
Figure 12:
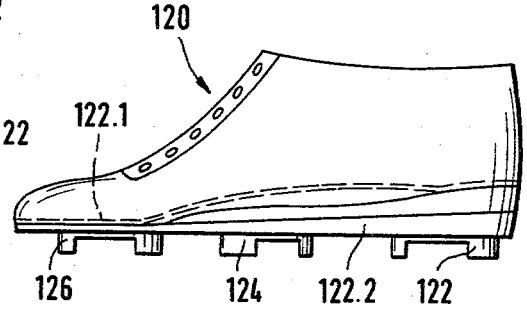
Figure 14:
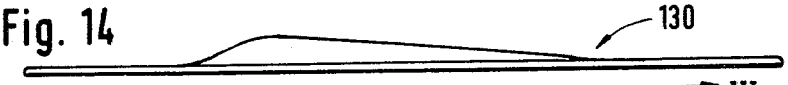
Figure 13:
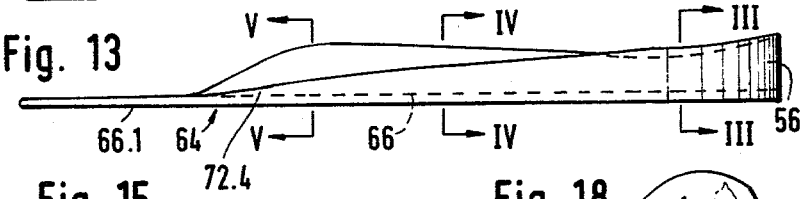

In the drawings there is shown in:

FIG. 1 a plantar view or a view from below of a first embodiment of a metatarsal arch support integral with an outer sole in accordance with the invention shown below the bone structure of a right foot;

FIG. 2 a side view of the metatarsal arch support and outer sole and the foot bone structure seen along arrow II in FIG. 1 (also refer to FIG. 13);

FIG. 3 on a larger scale, a sectional view of the heel portion of the support seen along arrows III—III in FIGS. 1,2 and 13;

FIG. 4 on a larger scale, a sectional view of the medial portion of the support seen along arrows IV—IV in FIGS. 1,2 and 13;

FIG. 5 on a larger scale, a sectional view of the metatarsal portion of the support seen along arrows V—V in FIGS. 1, 2 and 13, this view being in a direction opposite to that of FIGS. 3 and 4;

FIG. 6 a side view of a sports shoe, eg a tennis shoe, provided with an integral metatarsal arch support in accordance with the invention;

FIG. 7 a view from below of a running shoe, provided with an integral metatarsal arch in accordance with the invention and indicating the position of the spikes;

FIG. 8 a side view of the running shoe seen along arrow VIII in FIG. 7;

FIG. 9 a view from below of a rugby boot, provided with an integral metatarsal arch support in accordance with the invention and indicating the position of the studs;

FIG. 10 a side view of the rugby boot seen along arrow X in FIG. 9;

FIG. 11 a view from below of a baseball boot, provided with an integral metatarsal arch support in accordance with the invention and indicating the position of the hooks;

FIG. 12 a side view of the baseball boot seen from along arrow XII in FIG. 11;

FIG. 13 on a larger scale, a side view of the metatarsal arch support integral with an outer sole corresponding to FIG. 2;

FIG. 14 a side view of a metatarsal arch support insert (i.e. integral with an inner sole) in accordance with the invention.

Figure 15:
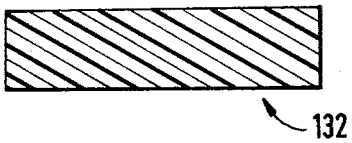
Figure 18:
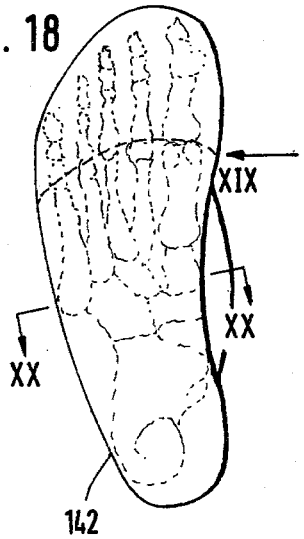
Figure 16:
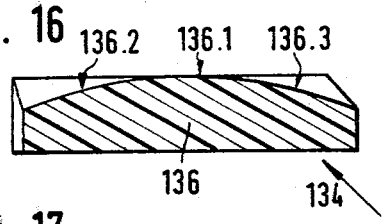
Figure 17:
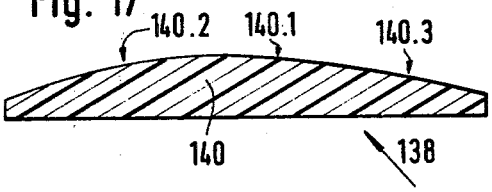
Figure 20:
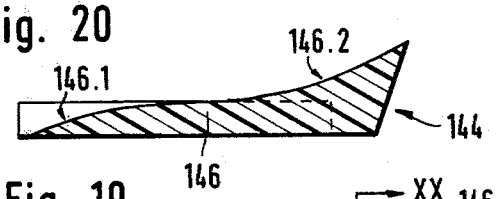
Figure 19:
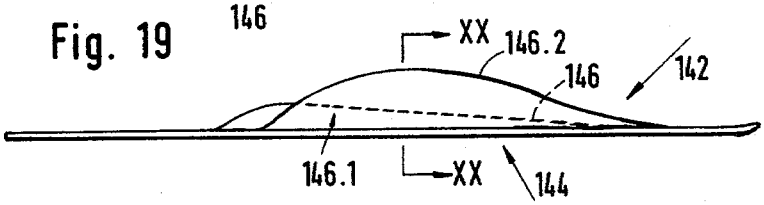

FIG. 15 a sectional view of the heel portion of a second embodiment of a support, the view corresponding to FIG. 3;

FIG. 16 a sectional view of the medial portion of a second embodiment of a support, the view corresponding to FIG. 4;

FIG. 17 a sectional view of the metatarsal portion of a second embodiment of a support, the view corresponding to FIG. 5;

FIG. 18 a plantar view or a view from below of a second embodiment of a metatarsal arch support insert (integral with an inner sole) shown below the bone structure of the right foot, the view corresponding to FIG. 1;

FIG. 19 a side view of the metatarsal arch support insert and inner sole and the foot bone structure seen along arrow XIX in FIG. 18; and FIG. 20 on a larger scale, a sectional view of the medial portion of the support insert seen along arrows XX—XX in FIG. 18.

Referring to FIG. 1 a plantar view of the bones of the right foot are illustrated.

The various bones of the foot are indicated by the following reference numerals;

12: calcaneum
14: talus
16: cuboid bone
18: navicular bone
20: lateral cuneiform bone
22: medial cuneiform bone
24: intermediate cuneiform bone
26–34: First to fifth metatarsal bones
36–44: Proximal phalanges
46–54: Distal phalanges The talus 14 articulates with the tibia (not shown) both above and medially, and with the fibula (not shown) laterally. Below it articulates with the calcaneum 12 and with the plantar calcaneonavicular ligament, which connects the sustentaculum tali with the plantar surface of the navicular bone 18. Anteriorly the talus 14 articulates with the navicular bone 18.

On the anterior surface of the head of the talus 14 the convex articular facet fits into the posterior surface of the navicular bone 18. This is continuous on the plantar surface with small anterior and middle facets which are separated by a deep groove, called the groove of the talus (sulcus tali), from a larger posterior articular facet. All three of these plantar facets articulate with different parts of the calcaneum 12. Part of the head of the talus 14 also articulates with the plantar calcaneonavicular ligament. When the two bones are articulated the grooves of the talus and calcaneum together form the tarsal sinus.

The cuboid bone 16 anteriorly has facets for the bases of the fourth and fifth metatarsal bones. Medially, there is a facet for the lateral cuneiform bone 20.

The navicular bone 18 articulates with the three cuneiform bones, namely the medial cuneiform bone 22, the lateral cuneiform bone 20 and the intermediate cuneiform bone 24 anteriorly and with the talus 14 posteriorly. Laterally the navicular bone 18 frequently articulates with the cuboid 16.

The three cuneiform bones have articulations with the bases of the first, second and third metatarsal bones 26, 28, 30 respectively. The lateral cuneiform bone 20 also articulates with the cuboid 16, and all three articulate with the navicular bone 18 posteriorly.

The metatarsal bones 26–34 articulate with the proximal phalanges 36–44.

The bones as shown in the drawing are held together by means of tendons, muscles, and ligaments, details of which are not shown.

As is known two longitudinal arches are formed below the foot. The one is on the inside extending from the first metatarsal bone 26 to the calcaneum 12 and rises higher than the arch on the outside and is subject to great stress during use of the foot, in particular if strenuous movements are performed. The outer and shorter arch, which extends from the fifth metatarsal bone 34 to the calcaneum 12, carries the major part of the weight of the body.

Furthermore, movement takes place in the joint between the metatarsal bones 26–34 and the proximal phalanges 36–44 and also between the metatarsal bones 26–34 and the various cuneiform bones 20–34 and the cuboid bone 16.

These bones and arches have to be supported correctly so that they retain their natural formation and location whilst being able to take up the stress acting on them and yet they must have sufficient freedom of movement to take up shock loads. Thus strain on the muscles of the foot and leg can be relieved and this avoids pain and injury.

The invention will now be described by referring to the various drawings.

Referring to FIGS. 1 and 2, the metatarsal arch support 56 comprises a heel portion 58, a medial portion 60 and a metatarsal portion 62 terminating in a rounded metatarsal edge 64. The support 56 is joined to or integral with an outer sole 66, which has a front sole part 66.1 in the region of the toes.

It must be noted that the support 56 is shown in side view schematically in FIGS. 2,6,8,10 and 12, but that an accurate side view is shown in FIG. 13.

Various cross-sections of the support 56 are shown in FIGS. 3,4 and 5. It can be seen (FIG. 3) that the heel portion 58 is spherically recessed or has a cup formation 68 so as to receive the formation of the calcaneum bone 12. FIG. 4 shows the single wave shape 70 of the medial portion 60, with the peak 70.1 being positioned under the inner arch of the foot. Towards the outside 70.2 the single wave shape flattens out to below the outer arch of the foot and it is almost of concave shape whereas on the inside 70.3 the single wave shape is of convex form to be situated a short distance below the inner arch of the foot. The shape of the central part of the metatarsal portion 62 is illustrated in FIG. 5. The metatarsal portion 62 is also of single wave shape 72, but wider and flatter than the single wave shape 70 of the medial portion 60, so as to follow the inner and outer arches of the foot. Furthermore the metatarsal portion 62 flattens at 72.4 (see FIG. 2) towards the round edge 64. The edge 64, as is shown clearly in FIG. 1, substantially follows the joint between the metatarsal bones 26–34 and the proximal phalanges 36–44.

The support 56 can be made of any suitable material, which is sufficiently stiff but yet would provide some resiliency to take up shock loads or excessive deformation resulting from other reasons.

FIG. 6 illustrates a sports shoe 74 (eg running shoe) provided with an integral metatarsal arch support 56 as illustrated in FIGS. 1 to 5. The support 56 is built into the shoe and above it the usual inner sole 76.1 and below it the outer sole 76.2 are provided. The location of the support 56 relative to the bone structure of the foot would be as is illustrated in FIG. 1.

FIGS. 7 and 8 illustrate a running shoe 78 provided with spikes. This shoe 78 incorporates an integral metatarsal arch support (FIGS. 1 to 5), an inner sole 80.1 above it and an outer sole 80.2 below it. The position of the various spikes 82–92 is shown in FIG. 7. As is illustrated the rear spikes 82, 84 respectively provided between the first and second metatarsal bones 26, 28 and between the fourth and fifth metatarsal bones 32 and 34. The intermediate spikes 86, 88 are placed respectively towards the back of the first proximal phalanx 36 and the fifth proximal phalanx 44. The front spikes 90, 92 are located respectively under the first distal phalanx 46 and the fourth distal phalanx 52.

The spikes 82–92 have been placed strategically in those positions where the greatest loads occur. Thus such loads are supported directly on the soil or other supporting surface and avoid a bending through of the foot against the natural formation of the various arches. The greatest loads occur at the positions of the rear spikes 82, 84 and these are situated approximately below the changeover from the medial portion 60 to the metatarsal portion 62 of the support 56. As mentioned before the inner arch of the foot is not in direct contact with the support 56 so as to allow some movement to take up shock loads.

In FIGS. 9 and 10 a rugby or soccer shoe or boot 94 is illustrated. This shoe 94 also includes an integral metatarsal arch support 56 (FIGS. 1 to 5), an inner sole 96.1 on top of it and an outer sole 96.2 below it. The position of ten strategically placed studs 98–116 is shown in FIG. 9. Two studs 98, 100 are provided at the heel under the calcaneum 12. The next two studs 102, 104 are located below the arch formed between the various cuneiform bones 20–24 and the cuboid bone 16 on the one hand and the metatarsal bones 26–34 on the other hand. The following studs 106, 108 are respectively provided between the first and second metatarsal bones 26, 28 and between the fourth and fifth metatarsal bones 32, 34. The stud 110 is placed on the rear side of the first proximal phalanx 36. The stud 112 is in front of the joint of the fifth proximal phalanx 44 and the fifth metatarsal bone 34. The front stud 114 is below the first distal phalanx 46 whereas the stud 116 is below the fourth distal phalanx 52. In place of or in addition to the studs 114 and 116 a single stud 118 may be provided centrally in front, ie between the second and third distal phalanges 48, 50, for better gripping, e.g. for rugby players playing in the front row. The front stud 118 could be slightly shorter than the other studs.

In FIGS. 11 and 12 a baseball shoe 120 is illustrated, which includes an integral metatarsal arch support 56 (FIGS. 1 to 5), an inner sole 122.1 and an outer sole 122.2. The position of three hook members 122, 124, 126 is shown in FIG. 11. The rear hook 122 is below the calcaneum 12. The central hook 124 is below the various cuneiform bones 20, 22, 24 and the start of the various metatarsal bones, whereas the front hook 126 is below the second proximal phalanx 38 and the third proximal phalanx 40 and extends over to the metatarsal bones.

FIG. 13 shows the metatarsal arch support 56 of FIG. 2 on a larger scale for purposes of clarity. The thickness of the outer sole can vary as may be required.

FIG. 14 shows a metatarsal arch support insert 130, i.e. integral with an inner sole. This insert 130 can be placed into shoes. It has the same curvature on top as the support 56 of FIG. 13 and the preceding drawings, and also has a slight spherically recessed heel portion, which also may be flat.

Referring to FIGS. 15 to 17 the sectional views of the support shown indicate that the support has a different cross-sectional shape. However, the plan and side views of the support would be as in FIGS. 1, 2 and 13. Here the heel portion 132 (FIG. 15) is flat. The medial portion 134 (FIG. 16) has a single wave shape 136 with the peak 136.1 being positioned under the inner arch of the right foot. On both sides 136.2 and 136.3 the single wave shape is of convex form. The metatarsal portion 138 (FIG. 17) is also of single wave shape 140 and is of convex shape on both sides 140.2 and 140.3, and has a peak 140.1.

In FIGS. 18 to 20 a second support insert 142 is shown. Here the heel and metatarsal portions are similar to the top sections shown in FIGS. 3 and 5 (or FIGS. 15 or 17) but the medial portion 144 is different. It is of waved shape 146 and is convex on one side 146.1 and, under the inner arch of the foot, is of raised shape 146.2 so as to provide an extra comfort. The raised shape 146.2 can be in the form of a separate pad added to a support of the type of FIGS. 3 and 5 (or FIGS. 15 and 17).

As is shown in FIGS. 2, 10, 12, 13, 14 and 19 in longitudinal section the metatarsal arch support in each case includes a single wave formation or shape (i.e., a wave having a single peak) in the medial and metatarsal portions taken together.

I claim:

1. A sports shoe adapted for use as a running shoe, said shoe including a metatarsal arch support comprising:

(a) a heel portion;

(b) a medial portion extending from the heel portion; and (c) a metatarsal portion extending from the medial portion and terminating in a rounded metatarsal edge; which support increases in width from the medial portion to the metatarsal edge;

(d) the medial portion having a transverse cross-sectional shape in the form of a single wave;

(e) the metatarsal portion having a transverse cross-sectional shape in the form of a single wave, which latter wave is flatter than the wave of the medial portion, and the metatarsal portion flattening by way of a wedge-shaped portion, as viewed in longitudinal cross-section, into the rounded metatarsal edge;

(f) the metatarsal edge being adapted in use to be located substantially below the joints of the five metatarsal bones to the proximal phalanges of the foot of a wearer; and (g) the arch support further having a longitudinal cross-sectional shape, in the medial and the metatarsal portions taken together, in the form of a single wave, the peak of the last mentioned wave being located in the metatarsal portion;

(h) the shoe further including a plurality of spikes arranges such that two rear spikes are respectively located between the first and second metatarsal bones and between the fourth and fifth metatarsal bones, two intermediate spikes are located respectively towards the back of the first proximal phalanx and the fifth proximal phalanx, and two front spikes are located respectively under the first distal phalanx and the fourth distal phalanx.

2. A sports shoe adapted for use as a rugby or soccer shoe, said shoe including a metatarsal arch support comprising:

(a) a heel portion;

(b) a medial portion extending from the heel portion; and (c) a metatarsal portion extending from the medial portion and terminating in a rounded metatarsal edge; which support increases in width from the medial portion to the metatarsal edge;

(d) the medial portion having a transverse cross-sectional shape in the form of a single wave;

(e) the metatarsal portion having a transverse cross-sectional shape in the form of a single wave, which latter wave is flatter than the wave of the medial portion, and the metatarsal portion flattening, by way of a wedge-shaped portion, as viewed in longitudinal cross-section, into the rounded metatarsal edge;

(f) the metatarsal edge being adapted in use to be located substantially below the joints of the five metatarsal bones to the proximal phalanges of the foot of a wearer; and (g) the arch support further having a longitudinal cross-sectional shape, in the medial and the metatarsal portions taken together, in the form of a single wave, the peak of the last mentioned wave being located in the metatarsal portion;

(h) the shoe further having ten support studs, arranged such that two studs are located at the heel under the calcaneum, two studs are located below the arch formed between the various cuneiform bones and the cuboid bone on the one hand and the metatarsal bones on the other hand, two studs are located respectively between the first and second metatarsal bones and between the fourth and fifth metatarsal bones, one stud is located on the rear side of the first porximal phalanx, one stud is in front of the joint of the fifth proximal phalanx and the fifth metatarsal bone, a front stud is located below the first distal phalanx and a stud is located below the fourth distal phalanx.

3. A sports shoe, adapted for use as a baseball shoe, said shoe including a metatarsal arch support comprising:

(a) a heel portion, (b) a medial portion extending from the heel portion; and (c) a metatarsal portion extending from the medial portion and terminating in a rounded metatarsal edge; which support increases in width from the medial portion to the metatarsal edge;

(d) the medial portion having a transverse cross-sectional shape in the form of a single wave;

(e) the metatarsal portion having a transverse cross-sectional shape in the form of a single wave, which latter wave is flatter than the wave of the medial portion, and the metatarsal portion flattening, by way of a wedge-shaped portion, as viewed in longitudinal cross-section, into the rounded metatarsal edge;

(f) the metatarsal edge, in use, being located substantially below the joints of the five metatarsal bones to the proximal phalanges of the foot of a wearer; and (g) the arch support further having a longitudinal cross-sectional shape, in the medial and the metatarsal portions taken together, in the form of a single wave, the peak of the last mentioned wave being located in the metatarsal portion;

(h) the shoe further having a plurality of cleats, arranged such that a rear cleat is located below the calcaneum, a central cleat is located below the various cuneiform bones and the start of the various metatarsal bones, and a front cleat is located below the second proximal phalanx and the third proximal phalanx.

4. A sports shoe as claimed in claim 3, in which further two front cleats are provided, said front cleats comprising a cleat located below the fifth proximal phalanx and a cleat located below the fourth distal phalanx.

5. A shoe including a metatarsal arch support comprising:

(a) a heel portion;

(b) a medial portion extending from the heel portion; and (c) a metatarsal portion extending from the medial portion and terminating in a rounded metatarsal edge; which support increases in width from the medial portion to the metatarsal edge;

(d) the medial portion having a transverse cross-sectional shape in the form of a single wave;

(e) the metatarsal portion having a transverse cross-sectional shape in the form of a single wave, which latter wave is flatter than the wave of the medial portion, and the metatarsal portion flattening by way of a wedge-shaped portion, as viewed in longitudinal cross-section, into the rounded metatarsal edge;

(f) the metatarsal edge being adapted in use to be located substantially below the joints of the five metatarsal bones to the proximal phalanges of the foot of a wearer; and (g) the arch support further having a longitudinal cross-sectional shape, in the medial and the metatarsal portions taken together, in the form of a single wave, the peak of the last mentioned wave being located in the metatarsal portion.

6. A shoe as claimed in claim 5, in which the heel portion is spherically recessed to receive the calcaneum formation.

7. A shoe as claimed in claim 5, in which the wave of the medial portion has a peak which, in use, follows approximately the joint between the cuboid bone and the talus and navicular bone and is located below the lateral cuneiform bone.

8. A shoe as claimed in claim 5, in which the support is made of resilient material.

9. A shoe as claimed in claim 5, in which the support is integral with the shoe sole structure.

10. An insert for shoes comprising:

(a) a heel portion;

(b) a medial portion extending from the heel portion; and (c) a metatarsal portion extending from the medial portion and terminating in a rounded metatarsal edge;

(d) the medial portion having a transverse cross-sectional shape in the form of a single wave;

(e) the metatarsal portion having a transverse cross-sectional shape in the form of a single wave, which latter wave is flatter than the wave of the medial portion, and the metatarsal portion flattening by way of a wedge-shaped protion, as viewed in longitudinal cross-section, into the rounded metatarsal edge;

(f) the metatarsal edge being adapted in use to be located substantially below the joints of the five metatarsal bones to the proximal phalanges of the foot of a wearer; and (g) the insert further having a longitudinal cross-sectional shape, in the medial and the metatarsal portions taken together, in the form of a single wave, the peak of the last mentioned wave being located in the metatarsal portion.

11. An insert as claimed in claim 10, in which the wave shape of the medial portion has a raised part adapted in use to be located under the inner arch of a foot.

12. An insert as claimed in claim 10, in which the heel portion is spherically recessed so that it is adapted in use to receive the calcaneum formation.

13. An insert as claimed in claim 10, which is made of resilient material.

* * * * *